United States Patent [19]

Puretic

[11] 4,354,444

[45] Oct. 19, 1982

[54] SAIL HANDLING APPARATUS

[76] Inventor: Mario J. Puretic, 259 - 6th Ave. N., Monte Cristo Isle, Tierra Verde, Fla. 33715

[21] Appl. No.: 237,519

[22] Filed: Feb. 23, 1981

[51] Int. Cl.[3] ..... B63H 9/10

[52] U.S. Cl. ..... 114/105; 114/102; 114/104

[58] Field of Search ..... 114/102, 103, 104, 105, 114/39

[56] References Cited

U.S. PATENT DOCUMENTS 639,916 12/1899 Achterberg ..... 114/105

843,822 2/1907 Jennings ..... 114/105

4,280,431 7/1981 Sofen ..... 114/105

*Primary Examiner*—Trygve M. Blix

*Assistant Examiner*—C. T. Bartz

*Attorney, Agent, or Firm*—Fulwider, Patton, Rieber, Lee and Utecht

[57] ABSTRACT

Sail handling apparatus that includes a pair of aligned generally triangular panels secured along a boom and to a portion of the mast above the boom. The panels normally straddle the boom to define an open-topped, sail-receiving pocket. The sail can be lowered into the pocket and the top of the panels overlapped to cover the sail.

4 Claims, 4 Drawing Figures

SAIL HANDLING APPARATUS

BACKGROUND OF THE INVENTION

Considerable difficulty can be encountered when lowering a conventional mainsail from its raised position to its furled position on a boom. The sail tends to flap and spills over both sides of the boom blocking the helmsman's vision. Several gasket fasteners must be secured around the sail and the boom after the sail has been lowered. The furling and securing operation requires several crewmen where a large mainsail is employed. The sail furling and securing process is particularly difficult under rough weather conditions. It has heretofore been proposed to provide a loose-footed furling mainsail to facilitate handling of such sail. Furling mainsails, however, are not as efficient as conventionally mounted mainsails, especially when the sailboat is going to weather. Additionally, the cost of furling mainsail systems is relatively high. It has also been proposed to retract the mainsail into the mast. Such system is also comparatively expensive and is prone to be unreliable.

SUMMARY OF THE INVENTION

It is a major object of the present invention to provide sail handling apparatus which greatly facilitates managing a sail when it is lowered from its raised position into a furled position on a boom. Such apparatus includes a pair of aligned generally triangular cloth or meshy panels supported upon the boom with their front edges normally attached to the mast above the boom. These panels normally straddle the boom to define an open-topped, sail-receiving pocket. The sail is readily lowered into the pocket between the panels, and thereafter the upper portion of the panels are overlapped to cover the sail. Fastening means carried by the upper portion of the panels are then engaged to secure the panel around the lowered sail. This arrangement eliminates the difficulty encountered in wrapping gaskets around a lowered sail to secure such sail to the mast. Additionally, the sail will not overlap the boom during the furling process so as to obstruct the vision of the helmsman.

It is another object of the present invention to provide sail handling apparatus of the aforedescribed nature wherein the width of the pocket may be expanded to ensure that the sail will fall thereinto even during rough weather conditions.

Yet a further object of the present invention is to provide sail handling apparatus of the aforedescribed nature wherein the panels may be extended to a horizontal position so as to serve as an awning.

It is yet another object of the present invention to provide sail handling apparatus of the aforedescribed nature wherein the upper edges of the panels may be lowered to a vertical position so as to increase the effective sail area of the sail received by such apparatus.

Yet an additional object of the present invention is to provide sail handling apparatus of the aforedescribed nature which is simple of design, rugged of construction and may be economically manufactured.

These and other objects and advantages of the present invention will become apparent from the following detailed description when taken in conjunction with the appended drawings.

DESCRIPTION OF A PREFERRED EMBODIMENT

Figure 1:
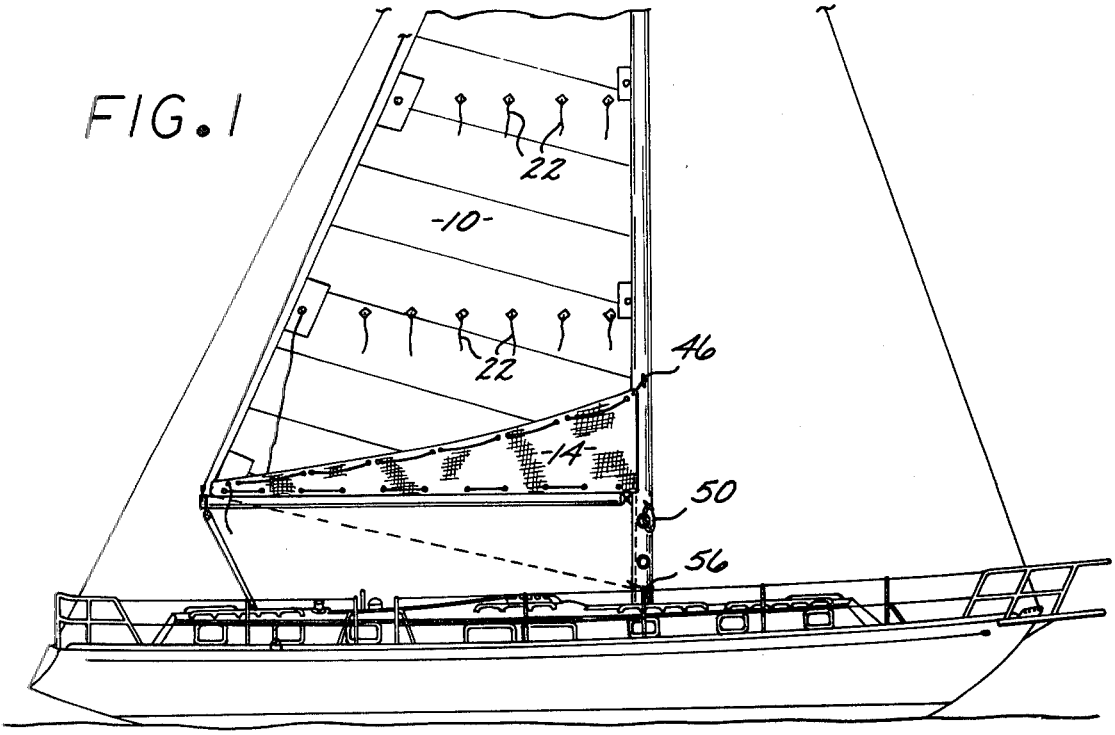
FIG. 1 is a broken side elevational view of a sailboat equiped with a preferred form of sail handling apparatus embodying the present invention.

Referring to the drawings, a preferred form of sail handling apparatus A is shown mounted upon the boom B and mast M of a conventional sailboat S. A mainsail 10 is supported by the mast M and boom B. The sail handling apparatus A includes a pair of aligned, generally triangular pliant panels, generally designated 12 and 14. The panels normally vertically straddle the boom to define an open-topped, sail-receiving pocket 16 above the boom. Fastening means, generally designated 18, are operatively interposed between the upper edges of panels 12 and 14. Such fastening means are not engaged when sail 10 is in a raised position. When sail 10 is lowered onto boom B, such sail falls into pocket 16. Thereafter, the upper portion of panels 12 and 14 are overlapped to cover the sail. Fastening means 18 are thereafter engaged to secure the panels around the lowered sail and onto the top of the boom.

More particularly, mainsail 10 is of conventional construction utilizing a plurality of vertically spaced slides (not shown) which are slidably engaged with a conventional track 20 secured to the rear edge of mast M. Boom B is likewise of conventional construction having its front end pivotally supported by the lower portion of mast M. The lower edge of sail 10 is attached to the boom. Sail 10 may also be provided with reefing points 22 in a conventional manner. Panels 12 and 14 will preferably be formed of the same type of pliant, textile material utilized to fabricate conventional sail covers. The lower edge 23 i.e. the horizontal leg of each of the panels may be secured to the boom B by removable lacing 30 which extends generally horizontally from a fitting 32 affixed to the aft end of the boom through a plurality of eyelets 33 horizontally spaced formed along the lower edge of each panel, and with the mid-portion of such lacing being looped around the mast M. The upper front portion of each panel 12 and 14 is formed with eyelets 36 and 38, respectively, to receive like lanyards 40 and 42. Lanyards 40 and 42 normally extend through lanyard eyes 44 and 46 affixed to mast M a short distance above the front edge 47 of each of the panels and downwardly to conventional cleats 48 and 50 secured to opposite sides of the mast below the boom.

The fastening means 18 preferably include a lacing lanyard 51 which is extended through a plurality of conventional lacing eyes 52, formed along the upper edge 53 of the panel 14. Such lacing lanyard 51 defines loops 54 between eyes 52 operatively engagable with a plurality of hooks 55 positioned along the intermediate portion of panel 12.

In the use of the aforedescribed sail handling apparatus, with the mainsail 10 in its raised position the panels 12 and 14 will normally be arranged as shown in their solid outline position of FIG. 1. The top of the front edge 47 of each of the panels will at this time be maintained in the raised position of FIG. 1 by the lanyards 40 and 42. In such position, the panels will not interfere with the normal function of the mainsail as such sail imparts propulsion to the sailboat S. With continued reference to FIG. 1, if desired the panels 12 and 14 may be lowered to their dotted outline position therein. Such lowering may be accomplished by freeing the lanyards 40 and 42 from cleats 48 and 50, with the lanyards thereafter being secured to lower cleats 56 affixed to opposite sides of the mast M. With the panels in such a lowered position they will serve to increase the area of the mainsail 10.

Figure 2:
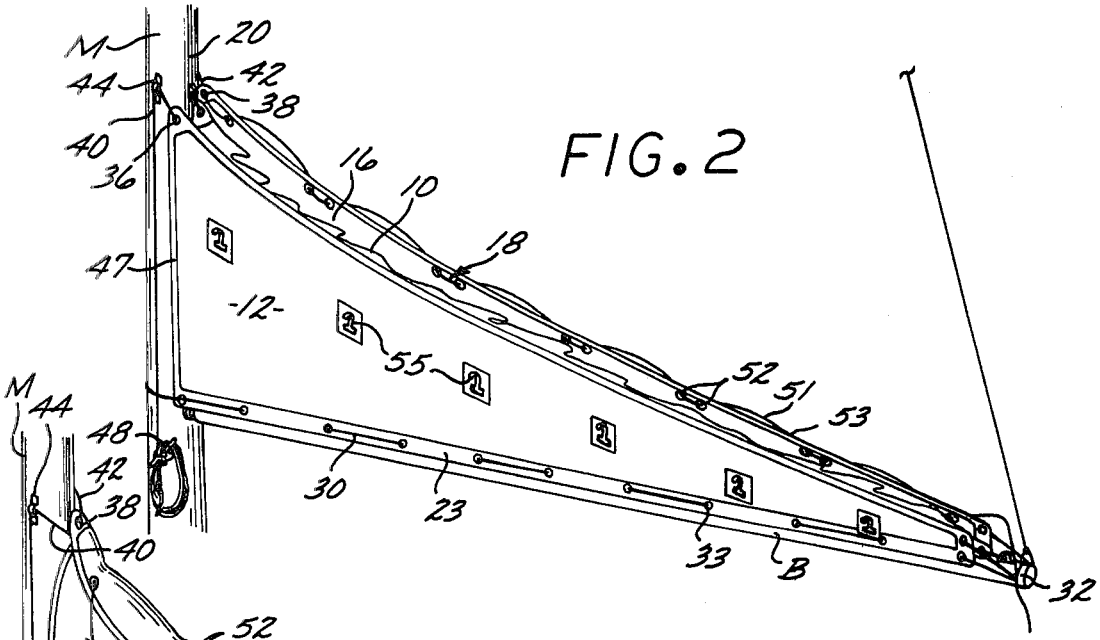
FIG. 2 is a perspective view showing such sail handling apparatus with the sail lowered thereinto.
Figure 3:
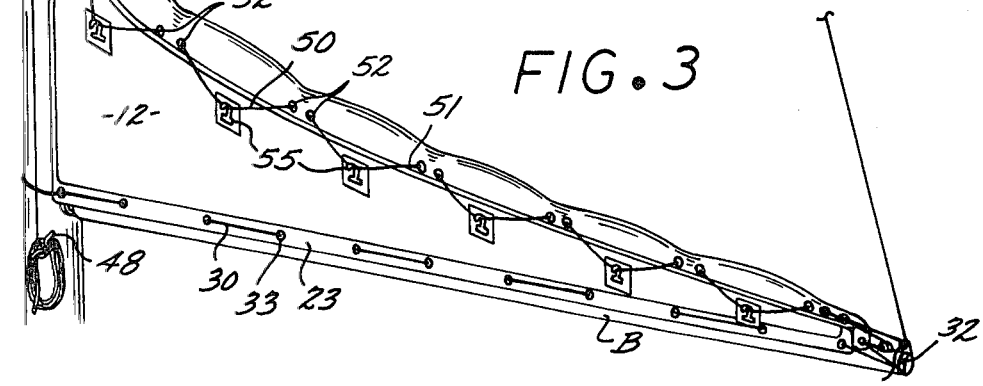
FIG. 3 is a perspective view similar to FIG. 2 showing the sail handling apparatus with its upper edges secured together so as to form a cover for the furled sail.

Referring now to FIG. 2, when the mainsail 10 is ready to be lowered, the panels 12 and 14 will be arranged in their normal position, i.e. vertically straddling the mast with the upper edges of the front panels 47 secured to the mast so as to define the sail-receiving pocket 16. As the mainsail 10 is lowered it will readily fall into pocket 18. A crewman may assist in effecting entrance of the mainsail into such pocket. After the mainsail has been dropped to its lowermost position between the panels 12 and 14, the upper portion of panel 14 will be overlapped with respect to the upper portion of panel 12, as indicated in FIG. 3. With continued reference to this figure, the lacing lanyard loops 54 will then be engaged with the hooks 55, so as to secure the panels in their overlapped position covering the mainsail. The overlapped and secured-together panels may then serve the function of a conventional sail cover. Alternatively, a conventional type of sail cover may be positioned over the secured-together panels. It should be noted that other forms of fastening means 18 may be provided. By way of example, the upper portion of the panels could be secured together by means of a zipper, or a Velcro type of securement could be operatively interposed between the upper edges of the overlapped panels. Even lines or conventional gaskets might be employed for this purpose.

Figure 4:
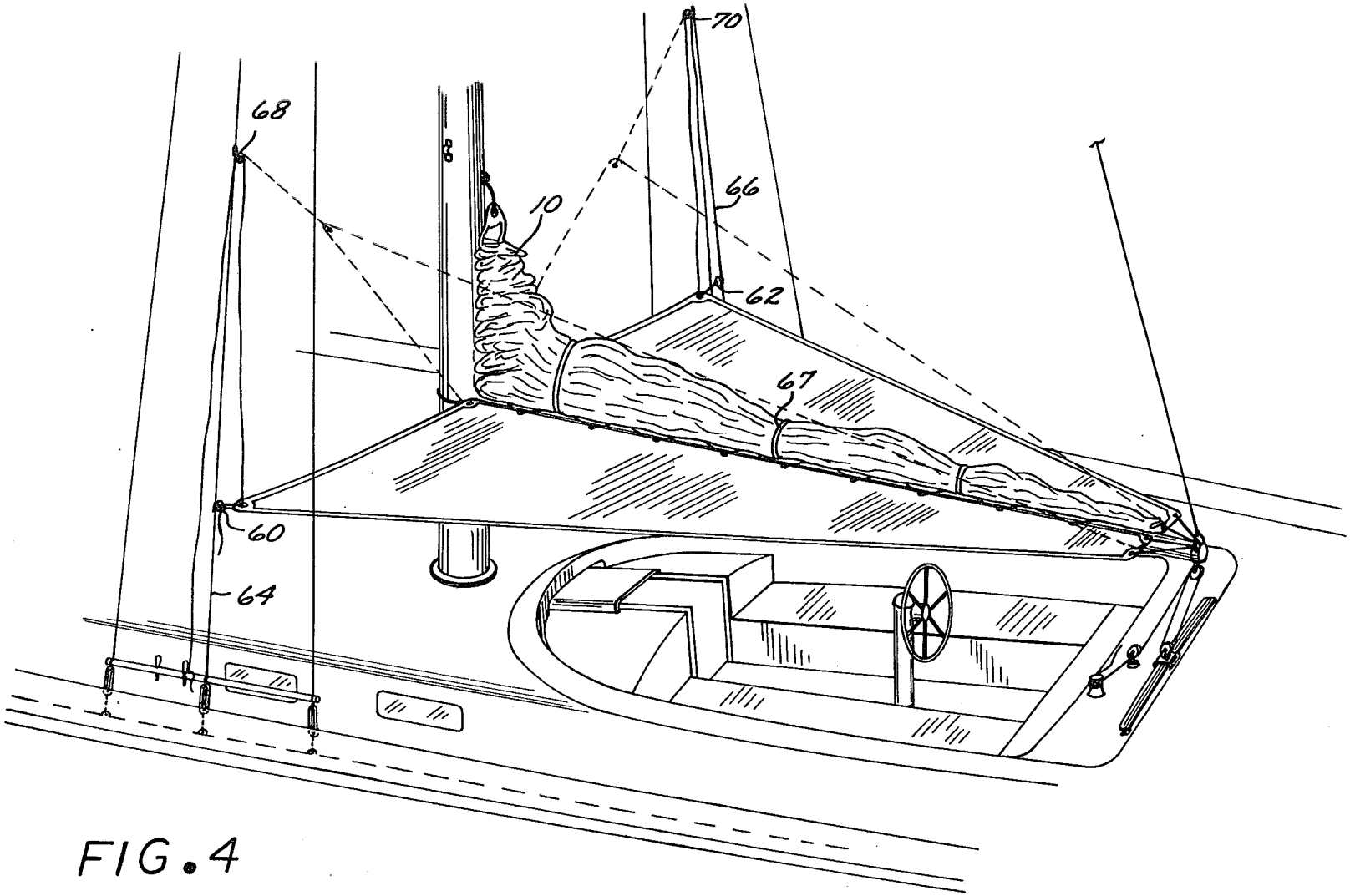
FIG. 4 is a perspective view showing how said sail handling apparatus may serve as an awning, with such figure also showing how the sail handling apparatus may be utilized in rough weather conditions.

Referring now to FIG. 4, if desired panels 12 and 14 may be arranged in a generally horizontal position so as to serve as an awning. The panels would be maintained in such a position by anchor lines 60 and 62, extended from eyelets 36 and 38 to shrouds 64 and 66. When the panels are disposed in a horizontal position the furled sail 10 may be secured upon the boom B by conventional gaskets 67.

With continued reference to FIG. 4, the panels 12 and 14 may be positioned at an upwardly extending angle to define a wider pocket 16' for collecting the mainsail 10 onto the boom under rough weather conditions. Such positioning of the panels may be accomplished by extending the lanyards 40 and 42 through a pair of blocks 68 and 70, carried by shrouds 64 and 66 at a point above the upper ends of the front edges 47 of each of the panels, as indicated in dotted outline in FIG. 4. The provision of the extended-width pocket 16' permits the mainsail to be lowered thereinto with little or no assistance from the crew of the sailboat.

Although the sail handling apparatus of the present invention has been described in conjunction with a mainsail, it may also be employed in conjunction with the mizzensail of a ketch or yawl.

From the foregoing description, it will be apparent that sail handling apparatus embodying the present invention permits a sail to be furled onto a boom without such sail sprawling over the deck so as to obstruct the helmsman's vision of boat traffic and/or a mooring. This is an important safety feature. The sail handling apparatus of the present invention also permits even large sails to be furled onto a boom utilizing but a single crewman. The sail may be readily collected on the boom even under rough weather conditions, particularly when the panels 12 and 14 are arranged at an expanded angle, as indicated in FIG. 4. The sail handling apparatus additionally eliminates the necessity of providing a sail cover and the time necessary to install and remove a conventional sail cover.

Various modifications and changes may be made with respect to the foregoing detailed description, without departing from the spirit of the present invention.

I claim:

1. Sail handling apparatus for use with a boat having a mast, a boom, and a sail supported by said mast and boom, said apparatus comprising:

a pair of aligned, generally triangular panels, each having a horizontal leg attached along said boom and a vertical front edge normally attached to said mast above said boom, the rear-end of each said panel being shorter than its front edge, with said panels normally straddling said boom to define an open-topped sail-receiving pocket;

and fastening means operatively interposed between the upper edges of said panels, said fastening means being open when said sail is in a raised position, with said sail falling into the pocket between said panels as said sail is lowered onto said boom from its raised position, whereafter the upper portion of said panels are overlapped to cover said sail and said fastening means are engaged to secure said panels around said lowered sail and onto the top of said boom.

2. Sail handling apparatus as set forth in claim 1, wherein means are operatively interposed between said panels and said boat to vary the angles assumed by said panels relative to said boom.

3. Sail handling apparatus as set forth in claim 1, wherein said fastening means includes a lacing lanyard carried by the upper edge of one of said panels selectively engageable with hooks positioned upon the other of said panels.

4. Sail handling apparatus as set forth in claim 2, wherein said fastening means includes a lacing lanyard carried by the upper edge of one of said panels selectively engageable with hooks positioned upon the other of said panels.

* * * * *